United States Patent [19]

Ashworth

[11] Patent Number: 4,580,308

[45] Date of Patent: Apr. 8, 1986

[54] BUFFING PAD AND METHOD OF MANUFACTURE

[75] Inventor: Lewis A. Ashworth, Orange, Calif.

[73] Assignee: BAF Industries, Santa Ana, Calif.

[21] Appl. No.: 715,336

[22] Filed: Mar. 25, 1985

[51] Int. Cl.[4] ..... A47L 25/00

[52] U.S. Cl. ..... 15/230.18; 15/230.12; 300/21

[58] Field of Search ..... 15/230, 230.12, 230.15, 15/230.17, 230.18, 230.19, 97 R; 300/21

[56] References Cited

U.S. PATENT DOCUMENTS

| | | | |
|---|---|---|---|
| 3,342,533 | 9/1967 | Engel et al. | 15/230.18 X |
| 3,717,894 | 2/1973 | Wakefield | 15/230.15 X |
| 3,990,124 | 11/1976 | MacKay, Jr. et al. | 15/230.12 |
| 4,149,294 | 4/1979 | MacKay, Jr. et al. | 15/230.18 |
| 4,403,367 | 9/1983 | Brown et al. | 15/230.12 |

*Primary Examiner*—Edward L. Roberts
*Attorney, Agent, or Firm*—Walter A. Hackler

[57] ABSTRACT

A contoured buffing pad includes a buffing disk which is heat-formed by the method of the invention so that a portion thereof proximate an outer edge thereof forms an approximate right angle with the remainder of the buffing disk. Additionally, the buffing pad includes a fusible center disk which is fused into a tapered shape during manufacture of the pad and also, in cooperation with the fusible means, secures stitches in the buffing disk and coaxially secures the center disk to a second side of the buffing disk. A hub coaxially mounted in the disk includes threads for attaching the hub to a drive shaft, thereby eliminating the need of a conventional face plate, or the like, to mount the buffing pad to a drive shaft or buffing motor.

10 Claims, 3 Drawing Figures

BUFFING PAD AND METHOD OF MANUFACTURE

The present invention generally relates to buffing pads for use in polishing automobiles and the like, and is more particularly directed to a "contoured" buffing pad which is easily attached and detached to the drive shaft of a buffing motor and a method of manufacturing the contoured buffing pad.

High speed buffing may utilize buffing pads rotated from between 1,750 and 3,000. Since the buffing pads may be 8 inches or more in diameter, a great amount of torque is applied to the pad as the buffer motor turns the buffing pad up to speed, and considerable forces are exerted on the pad during its contact with the surface during buffing.

Consequently, mounting of the pad to the drive shaft presents difficult problems.

In the past, buffing pads have been mounted to a drive shaft by means of a face plate, which bears against the front or nap side of the buffing pad, and is engaged by a bolt passing through the face plate and the buffing plate and into mating threads on the drive shaft, or a connector to the drive shaft.

Utilizing either right or left hand threads, depending upon the rotation of the pad, the bolt is continually tightened as the buffing pad is rotated, forcing the face plate against the pad and holding it to the drive shaft.

While simple in nature, this approach in mounting a buffing pad has a large number of disadvantages. First, the face plate itself may occupy a significant portion of the front of the buffing pad, hence, reducing the useable buffing area of the buffing pad.

In addition, since the face plate is not typically a soft buffing material, contact with a surface will cause scratching thereof, hence, the buffing process must be carefully controlled to avoid damage to the surface.

Finally, because of the large size of the buffing motor and the buffing pad, it is very difficult to change buffing pads since alignment between the buffing pad, the drive shaft, the face plate, and the bolt extending therethrough is necessary, all at the same time. In practice, this has proved to be awkward, difficult to accomplish, time-consuming and frustrating to an operator.

There is a need for a buffing pad, which may be mounted to a drive motor, without the need of a face-type plate, which can be quickly changed as the active surface of the buffing pad becomes clogged.

For example, an average buffing pad used in a commercial environment may have to be changed several times for each automobile polished, depending on many factors, including the condition of the automobile finish.

Because the buffing pad of the present invention does not include any protruding face plate to hold the buffing pad to a drive shaft, the entire exposed surface of the buffing pad may be utilized during the buffing process, hence, making the pad easier to use, while at the same time eliminating the possibility of damage to the surface being buffed.

In addition, since the face plate is eliminated and the total face of the buffing pad is available for buffing, buffing time may be reduced for any given surface.

Importantly, the buffing pad of the present invention has a contoured buffing surface, formed during the method of manufacture of the present invention which substantially reduces many of the surfaces burns or scratches due to edge contact of the buffing pad with the surface to be polished.

As will be hereinafter described, the buffing pad of the present invention may be attached and removed from a drive shaft in a simple manner without the alignment of a great number of parts, as is necessary in prior art buffing pads.

SUMMARY OF THE INVENTION

A buffing pad, in accordance with the present invention, includes a hub having means for releasably attaching the hub to a drive shaft, or the like.

A fusible center disk is provided, as well as means for mounting the hub coaxially with the center disk. The fusible buffing disk is capable of being heat-formed into a tapered shape, having a thickness which decreases from a position proximate a coaxial hole therein to an outer edge thereof.

A buffing disk is provided which has a plurality of yarn stitches protruding from a first side thereof and a plurality of yarn stitches exposed on a second side thereof. The plurality of yarn tufts are of sufficient number and density to provide a buffing nap on the first side of each buffing disk.

Fusible means, including a fusible material, are provided for securing the stitches in the buffing disk, coaxially securing the center disk to the second side of the buffing disk and forming the buffing disk so that a portion thereof proximate an outer edge thereof forms an approximate right angle with the remainder of the buffing disk and extends rearwardly in a direction toward a drive shaft when the hub is attached thereto.

In this manner the possibility of the outer edge of the buffing disk engaging, or cutting into, the surface being polished is significantly reduced.

While the buffing pad may be coupled directly to a drive shaft if the latter is properly adapted, the present invention also may include a connector having a male thread on one end thereof, and having another end adapted for attachment to a motor-driven drive shaft. In this instance, the hub has female thread means therein for releasably attaching to the connector.

In order to insure that the starting torque and torque applied to the hub during buffing does not tear it loose from the center disk and the buffing disks, a pair of washers may be provided, one on each side of the center disk and attached to one another through the center disk. In addition, the center disk may include means defining a plurality of holes therein for the fusible material to flow thereinto upon the application of heat.

Additionally, the center disk is heat-formed during assembly of the buffing pad, and, as a result of heat and pressure, decreases in thickness from a position adjacent a coaxial hole therein to an outer edge thereof.

This feathering, or tapering of the center support disk in the pad is important, because the pad must be flexible for conforming with curved surfaces toward the outer edges, yet at the same time maintaining a firm support toward the center thereof for application of pressure during buffing.

A method of manufacturing the buffing pad, in accordance with the present invention, comprises the steps of: (1) sewing a buffing disk with yarn to provide a plurality of yarn tufts protruding from the first side thereof and a plurality of yarn stitches exposed on a second side thereof; (2) coaxially mounting a hub to a fusible center disk; (3) providing a fusible material for securing the stitches in the buffing disk and securing the fusible center disk to the second side of the buffing disk; (4) fusing the fusible material into the second side of the buffing disk, fusing the fusible center disk to the second side of the buffing disk and heat-forming the buffing disk so that a portion thereof proximate an outer edge thereof forms an approximate right angle with the remainder of the buffing disk, the second side of the buffing disk being formed into a concave shape by said heat-forming.

It is important that during the fusing of the second sides of the buffing disk together with the hub and the center disk therebetween, that the center disk is heat-formed with the thickness of the center disk decreasing from the point adjacent a coaxial hole therein to an outer edge thereof.

BRIEF DESCRIPTION OF THE DRAWINGS

The advantages and features of the present invention will appear from the following description when considered in conjunction with the accompanying drawings, in which.

DETAILED DESCRIPTION

Figure 1:
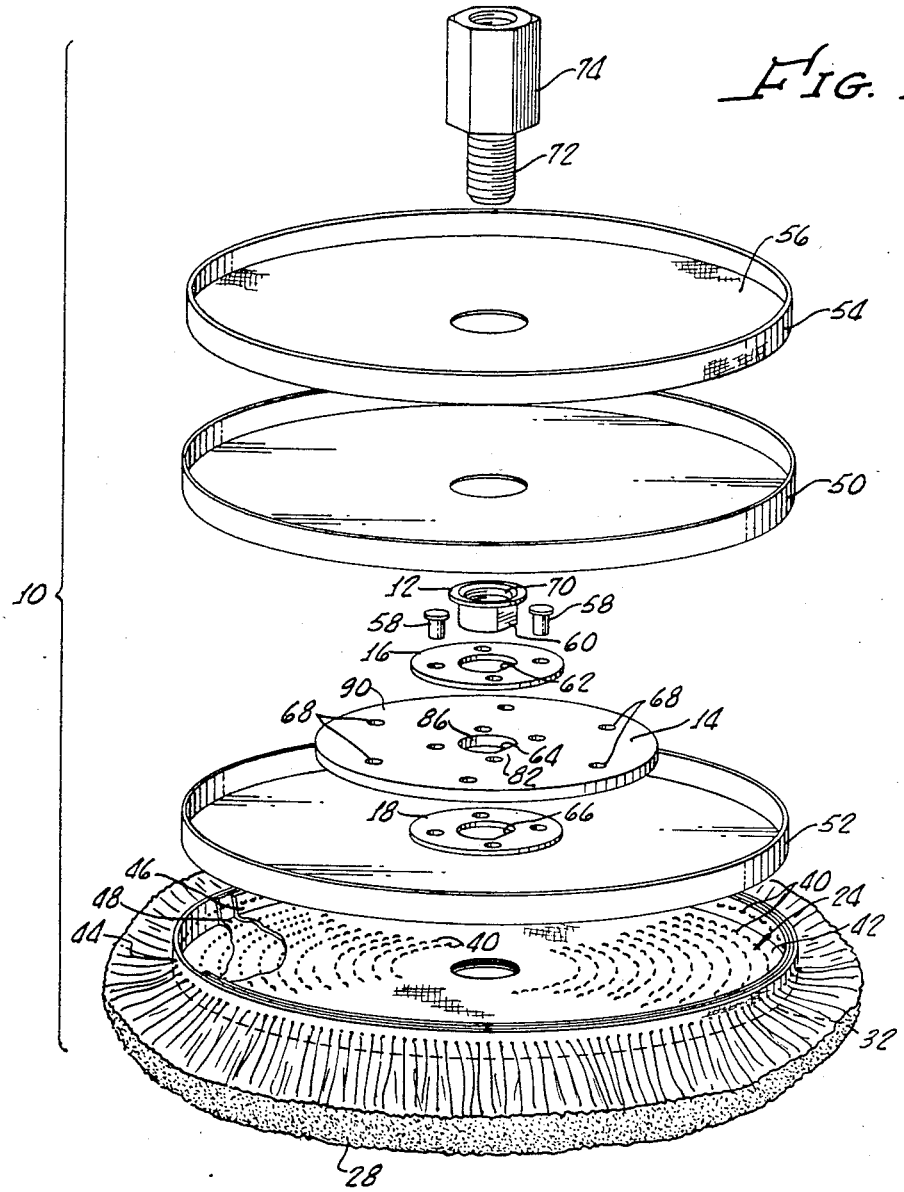
FIG. 1 is an exploded perspective view of a buffing pad, made in accordance with the present invention.

Turning to FIG. 1, there is shown a buffing pad 10, in accordance with the present invention, generally showing a hub 12, a center disk 14 and washers 16, 18, which, in part, provide a means for mounting the hub 12 coaxially with the center disk 14.

The buffing pad 10 also generally includes a buffing disk 24, having a plurality of yarn tufts 28, protruding from a first side 32, and a plurality of yarn stitches 40, exposed on a second side 42 of the disk 24.

More particularly, the disk 24 may be formed from two circular pieces of denim 44, 46, having a diameter of about 10 inches or more, which are fused together with a suitable material, such as polyethylene 48.

When the disk 24 is laminated, as will hereinafter be described, the denim 44, 46 pieces and fusible material 48 provide a buffing pad having sufficient flexibility at the periphery thereof to enable the pad to bend into curved portions of an automobile to provide for effective polishing thereon, while at the same time retaining sufficient rigidity to spring back to its original shape for flat polishing.

Layers of polyethylene disks 50 provide means for securing the stitches 40 in the buffing disks 24. Being a fusible material, the polyethylene disks 50, 52 when heated, penetrate into the second side 44 of the disk 24, thereby holding the stitches 40, as well as the yarn tufts 28, thereinto. A denim layer 54 provides a back, or reverse, side 56 of the buffing pad 10.

In addition, as will hereinafter be described in greater detail, the polyethylene disks 50, 52 also provide a means for securing the center disk 14 to the disks's second side 42.

The hub 12 is coaxially mounted with the center disk 14 by means of the washers 16, 18 which may be case hardened metal and disposed on each side of the center disk 14 and attached to one another and the center disk 14 by means of rivets 58, or the like.

To further inhibit a breaking away of the hub from the center disk and consequently the buffing disk 24, flat indexed areas 60, 62, 64, 66 may be formed into the hub 60 washer 16, center disk 14, and washer 18, respectively.

To further enhance the coupling of the center disk and hub to the buffing disks 24, 26, holes 68 may be provided in the center disk 14 to enable the fusible polyethylene material 50, 52 to flow thereinto during assembly of the buffing pad 10.

Female screw threads 70 are provided in the hub 12 for engagement with threads 72 disposed on a connector 74, which is adapted for attachment to a drive motor shaft, not shown.

It should be appreciated that the motor shaft itself may be fitted with screw threads for engagement with the hub 12, thus eliminating the need for the connector 74.

It is readily apparent that the connector 74, or drive shaft, can quickly engage the buffing pad hub 70.

While a great deal of manipulating must be done with prior art devices having a face plate and a screw therethrough to hold the pad to a drive shaft as hereinbefore described, the pad of the present invention can be engaged by the connector 74 or drive shaft without any handling if the pad is placed on a surface and the screw threads 68 and the hub 12 engaged by the connector screw thread 72, while the connector 74 is rotated, thus causing the hub 12 to screw onto the connector 74.

Figure 2:
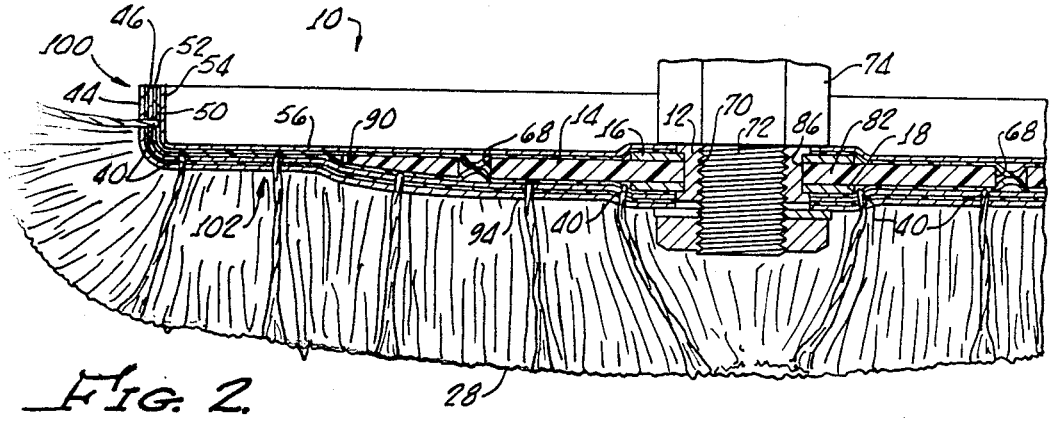
FIG. 2 is a cross-sectional view of the buffing pad, shown in FIG. 1, generally showing a center disk having a thickness which decreases from a position adjacent a coaxial hole therein to an outer edge thereof and the contoured shape of the buffing disk.

It can be seen from FIG. 2 that the center disk 14 of the present invention has a thickness which decreases from a position 82 adjacent the coaxial hole 86 to an outer edge 90.

As shown in FIG. 1 the disk is originally of uniform thickness, however, during the method of manufacture of the present invention, heating and pressing of the disk, as will be hereinafter described, causes the center disk 14 to be formed into the generally tapered configuration shown in the cross-section of FIG. 2.

As hereinbefore pointed out, it is important that the buffing pad have flexibility at its outer edge and decreased flexibility towards the center, to enable proper buffing on curved as well as flat surfaces.

Figure 3:
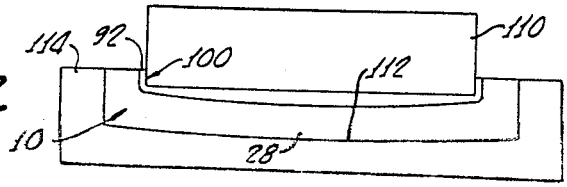
FIG. 3 is a representation of the method of the present invention.

Hence, it is preferred that the center disk have a tapered cross-section, as shown in FIG. 3, to enable a general increase in stiffness from an outer edge 92 of the pad to the center of the pad 94. The variation in thickness of the center disk 14 is dependent, in part, on the overall diameter of the pad 10, the thickness of the buffing disk 24 and the amount of tufts 28, and may be empirically determined.

In order to provide a buffing pad 10 which can be easily used at the edge 92 portion thereof without substantial risk of marring an automobile finish or the like, a portion 100 of the buffing pad proximate the outer edge 92 thereof is formed so as to be in an approximate right angle relationship with the remainder 102 of the buffing disk 24.

This forming may be done by heat and pressure as hereinafter described in connection with the method of the present invention.

It should be clear that with this "rounded" or "formed" shape of the buffing disk 24, and subsequent buffing pad 10 when assembled, that the buffing disk 24 has little chance of inverting when the buffing pad is being used, as may occur with a flat buffing pad.

Inverting of the buffing disk during polishing would, of course, expose the second side 56 thereof to the automobile surface which may cause scratching or burning thereof.

In the method of manufacturing a buffing pad, in accordance with the present invention, the two circular pieces 44, 46 of denim material are fused together by heating with a piece of polyethylene 48 therebetween.

Thereafter, the denim is sewed with a yarn to provide the plurality of yarn tufts 28 protruding from a first side 32 of the disk 24 formed by the two denim pieces and polyethylene. Extending through the disk, the yarn presents a plurality of stitches 40 exposed on a second side 42 of the disk.

The hub 12 is mounted to the center disk 14 by means of the washers 16, 18 and rivets 58 as hereinbefore described.

As illustrated in FIG. 3, a heating element 110, which may have a concave face 112 thereon is utilized to secure the stitches in the pad by fusing the polyethylene material 50, 52 thereinto coaxially securing the center disk 14 to the second side 42 of the buffing disk 24 and heat-forming the buffing disk 24, in cooperation with a mating press piece 114, so that a portion 100 proximate an outer edge 92 forms an approximate right angle with the remainder 102 of the buffing disk. The mating press piece 114 may also be heated and the contoured face 112 shaped in order to cause the center disk 14 to be heat-formed with the thickness of the center disk 14 decreasing from a portion 82 adjacent the coaxial hole 86 therein to an outer edge thereof.

Although there has been described hereinabove a specific arrangement of the buffing pad and its method of manufacture, in accordance with the present invention, for the purpose of illustrating the manner in which the invention may be used to advantage, it will be appreciated that the invention is not limited thereto. Accordingly, any and all modifications, variations, or equivalent arrangements, which may occur to those skilled in the art, should be considered to be within the scope of the invention as defined in the appended claims.

What is claimed is:

1. A buffing pad comprising:

a hub having means for releasably attaching said hub to a drive shaft or the like;

a fusible center disk capable of being heat-formed into a tapered shape having a thickness which decreases from a position proximate a coaxial hole therein to an outer edge thereof;

means for mounting said hub coaxially with said fusible center disk;

a buffing disk having a plurality of yarn tufts protruding from a first side thereof and a plurality of yarn stitches exposed on a second side thereof, said plurality of yarn tufts being of sufficient number and density to provide a buffing nap on the first side of the buffing disk; and, fusible means for (a) securing said stitches in said buffing disk, (b) coaxially securing said center disk to the second side of the buffing disk and (c) forming said buffing disk so that a portion thereof proximate an outer edge thereof forms an approximate right angle with the remainder of the buffing disk, and extends rearwardly in a direction toward the drive shaft when the hub is attached thereto.

2. The buffing pad according to claim 1 wherein said fusible means comprises at least one fusible disk.

3. The buffing pad according to claim 2 wherein said center disk includes means defining a plurality of holes therein for said fusible disk to flow thereinto upon the application of heat thereto.

4. The buffing pad according to claim 1 wherein said means for releasably attaching said hub to a drive shaft includes coaxial screw threads.

5. The buffing pad according to claim 4 wherein said means for coaxially mounting the hub to the center disk includes a pair of washers, one on each side of said center disk and attached to one another through said center disk.

6. The buffing pad according to claim 5 wherein said buffing disk comprises two fabric disks laminated by a fusible material.

7. The buffing pad according to claim 1 wherein said center disk is heat-formed during assembly of the buffing pad.

8. A method of manufacturing a buffing pad comprising the steps of:

sewing a buffing disk with a yarn to provide a plurality of yarn tufts protruding from a first side thereof and a plurality of yarn stitches exposed on a second side thereof;

coaxially mounting a hub to a fusible center disk;

providing a fusible material for securing said stitches in said buffing disk and securing said fusible center disk to the second side of the buffing disk;

fusing said fusible material into said second side of the buffing disk;

fusing said fusible center disk to the second side of the buffing disk; and heat-forming said buffing disk so that a portion thereof proximates an outer edge thereof forms an approximate right angle with the remainder of the buffing disk, said second side of said buffing disk being formed into a concave shape by said heat-forming.

9. The method of manufacturing a buffing pad according to claim 8 wherein said hub is mounted to the center disk by means of a pair of washers, one on each side of said center disk and attached to one another through said center disk.

10. The method of manufacturing a buffing pad according to claim 9 wherein during fusing the second sides of the buffing disk together with the hub and center disk therebetween causes the center disk to be heat-formed with the thickness of the center disk decreasing from a position adjacent a coaxial hole therein to an outer edge thereof.

* * * * *